United States Patent [19]

Rainville

[11] Patent Number: 4,605,223

[45] Date of Patent: Aug. 12, 1986

[54] ARCHERY EXERCISING DEVICE

[76] Inventor: Gérard Rainville, 8387 Bretagne St., Saint-Léonard, Canada, H1R 2W9

[21] Appl. No.: 697,024

[22] Filed: Jan. 31, 1985

[51] Int. Cl.[4] ..... A63B 21/00

[52] U.S. Cl. ..... 272/130; 124/90; 124/88; 124/1; 124/63; 272/93

[58] Field of Search ..... 272/130, 135, 141, 142, 272/93; 124/1, 41 R, 41 C, 90, 88, 63, 65, 66, 24 R

[56] References Cited

U.S. PATENT DOCUMENTS 4,041,927 8/1977 Van House ..... 124/24 R

FOREIGN PATENT DOCUMENTS 2076665 6/1980 United Kingdom ..... 272/130

*Primary Examiner*—Richard J. Apley
*Assistant Examiner*—J. Welsh

[57] ABSTRACT

There is disclosed a practice device to be used with a bow. This device comprises a cylindrical tube transversely secured to the main body of the bow, and a piston rod reciprocately engaging the tube according to the motion imparted thereto by the user. The inner end of the piston rod is abuttingly engageable by the bow-tensioning cord and is capable of stretching the latter outwardly from the bow main body. The piston rod is used as an arrow, except that it remains mounted in the cylindrical tube, never leaving the bow after release of the stretched tensioned bow cord.

5 Claims, 3 Drawing Figures

ARCHERY EXERCISING DEVICE

FIELD OF THE INVENTION

This invention relates to practicing devices for archery and, more particularly, to a piston and cylinder arrangement for use with a bow in practicing archery without a target butt.

BACKGROUND OF THE INVENTION

There are between ten and twenty million bowmen in North America. All these persons require some level of practicing in order to remain keen in their abilities.

Archery is challenging in that one needs to stretch and maintain the tensioning of the bow cord with an arrow and, at the same time, adjust and maintain the aiming at the target. To aim correctly, the bowman must see all together the cord, which is at a distance of about two centimeters from his eye, the sighting mark located on the solid part of the bow, and the target. This being realized, the bowman must then release the arrow. This control and coordination exercise is extremely demanding.

Understandably, there have been in the past a lot of problems for archers to practice their shooting skills, because it has always been necessary for them to have a lot of space.

Conventionally, to develop an adequate shooting stance, archers stand in front of a mirror to examine the position of their body, arms elbows, hands and fingers and correct the same if required. Obviously, by looking continuously at the mirror, if you let go the arrow, the latter will hit anything but the target butt and, consequently, will be ruined.

OBJECTS OF THE INVENTION

Accordingly, the main object of the present invention is to provide an archery practicing device, which will enable an archer to practice his movements, make proper corrections by looking in a mirror, and to warm up the muscles associated with arrow shooting without worrying about the arrow.

Another object of the invention is to provide an archery practicing device which allows the user to practice in a restricted area, in front of a mirror and without having to use a target and a target butt.

Another object of the present practicing device is to permit an archer to practice with his non-dominant shooting side, in order to balance out the upper body muscle development and stop signal curve associated with the practice of shooting always from the same side.

SUMMARY OF THE INVENTION

The practicing device of the present invention is for use with a bow, whether conventional or compound, left handed or right handed. The device comprises a shooting member having a first part slidably extending transversely of the bow main body in reciprocating fashion, and a second part fixedly secured thereto. The inner end of the first part is abuttingly engageable by the cord and is capable of stretching the latter outwardly from the rigid body.

The angle of the shooting member relative to the bow main body may be variably adjusted by a pair of rods, diverging upwardly and downwardly from the shooting member second part, toward and fixed to the bow rigid main body. The rods have means, such as corresponding turnbuckles, to relatively vary the effective length of the rods.

The shooting member first part should be a rod, and the second part a hollow cylinder tube reciprocately engageable by the rod. The cylinder is completely closed at its outer end, while the inner end is closed by an oil seal which surrounds and contacts the rod. The latter has a cylindrical piston at its outer end within the cylindrical tube, and a central recess at its inner end engageable by the cord. The tube contains a certain volume of non-compressible liquid, and there are passage means to allow some of the liquid to flow around the piston fore and aft thereof, upon reciprocating motion of the piston therewithin, so as to slow down the motion of the rod.

DETAILED DESCRIPTION OF THE PREFERRED EMBODIMENT

Figures 1, 2, 3:
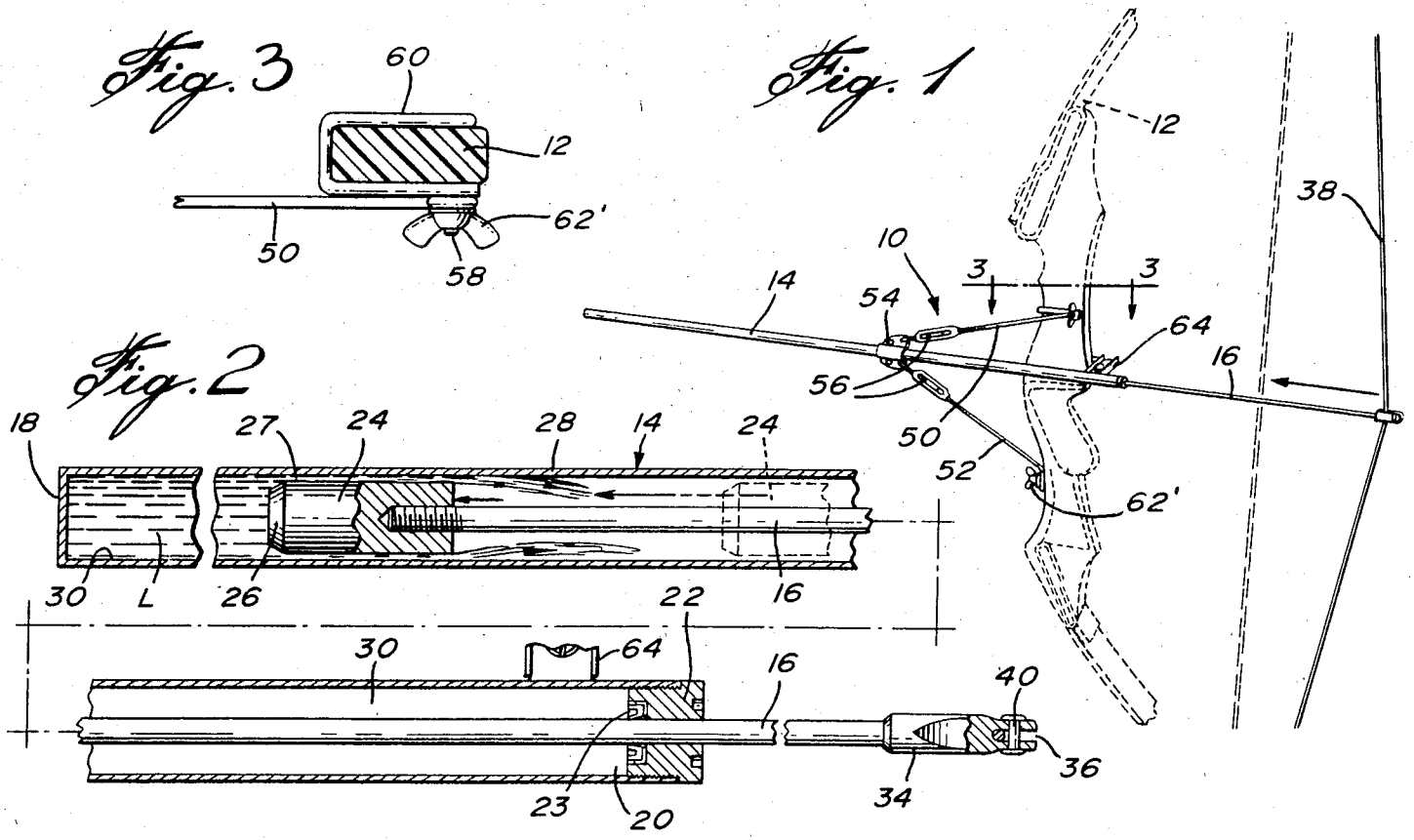
FIG. 1 is an elevation of a bow shown in dotted lines and including the exercising archery practicing device of the invention.
FIG. 2 is a fragmented longitudinal sectional view of the oil-filled cylinder and piston rod, forming part of the practicing device.
FIG. 3 is a cross-sectional view taken along line 3—3 of FIG. 1.

The practicing device of the invention, generally indicated by numeral 10, is adapted to be removably secured to a bow 12. The present invention essentially comprises a cylindrical hollow tube 14, into which is slidingly engaged a piston rod 16. This arrangement permits an archer to practice his sporting activity without requiring to shoot an arrow.

Tube 14 should be made of a sturdy material, such as copper, plastic, steel, aluminum or the like. This tube is closed at one end 18 and has an open end 20 closable by a threaded plug 22, which is centrally pierced and provided with a sealing ring 23, to allow sliding engagement of piston rod 16 therethrough.

The inner end of rod 16, within tube 14, is threadably secured to a cylindrical piston 24, which has an inner frustoconical front portion 26 on the side of the tube closed end 18. The plug 22, together with the closed end 18 and the peripheral wall 28 of the tube 14, define a chamber 30, which is filled with a viscous, non-compressible liguid L, such as oil. FIG. 2 shows chamber 30 as partially filled only for purpose of clarity to show that there must exist a restricted liquid passage through or around piston 24. In the example shown, the piston outer diameter is smaller than the inner diameter of wall 28 to define passage 27. This is in order to permit the liquid in the chamber 30 to transfer from upstream to downstream of piston 24 during its forward movement toward closed end 18. This is clearly illustrated in FIG. 2 and resembles closely a shock-absorber arrangement. The front portion 26 is preferably frusto-conical to permit the liquid in chamber 30 to flow more readily outwardly therefrom around piston 24 and, thus reduce liquid turbulence.

The gap between the outer diameter of piston 24 and the inner diameter of wall 28 should be sufficiently small to effect the necessary damping of the forward movement of piston 24 under the force of bow string 38.

Gasket 23 constitutes a tight seal against liquid leakage.

Of course, metal rod 16 is operated like an arrow and discloses at its free outer end an enlarged member 34 having an endmost central longitudinal recess 36. Recess 36 is engageable by the tensioning cord 38 of the bow 12. A pin 40 extends transversely of recess 36 and is removably fixed to the outer end of enlarged member 34 to retain cord 38 within recess 36.

Tube 14 is secured to the bow 12 by two rigid braces, or rods 50, 52, diverging therefrom, upwardly and downwardly, respectively. One end of rods 50, 52 is adjustably secured to a bracket 54 fixedly mounted to an intermediate part of the tube 14 by corresponding turnbuckles 56 and are fixedly secured at their other end to the intermediate part of the bow 12. The end of lower rod 52 is directly fixed to bow 12 by a shouldered thumb screw 62' engaging a threaded bore normally found on such bows 12. The end 58 of upper rod 50 is secured to a U-shaped bracket 60 by a bolt 58 fixed to the latter and by a wing nut 62. Bracket 60 frictionally surrounds the front and sides of bow 12. An L-shaped stop member 64 is fixed laterally of tube 14 and abuts against the rear face of bow 12. Braces 50 are then strained in compression by turnbuckles 56. Selective actuation of the turnbuckles 56 also permits to adjust the angle made by tube 14 relative to bow 12. Typically, this means that, for an upstanding person holding the bow 12 operational-vertical-position, the tube 14 may be pivoted from the horizontal, slightly upwardly or slightly downwardly, so as to set tube 14 at the proper angle.

When cord 38 is fully pulled away from box 12, piston 24 abuts or is proximate to plug 22. Thereafter, releasing the pulling action on rod 16 permits the latter to yield to the bias of cord 38, which will propel rod 16 forwardly inside tube 14, like with an arrow.

However, the kinetic energy of rod 16 and piston 24 within tube 14 is used transferring liquid L from upstream to downstream of piston 24 through restricted passage 27. This passage 27 has dimensions such as to permit piston 24 to reach closed end 18, but without striking the latter. Retracting piston 24 only requires a small force, since retraction is effected at a low speed. The rod 16 is kept from leaving the shooting device, so that there is no need for a target butt.

With this practicing device, archers may practice and train any time and anywhere they like.

What I claim is:

1. A practice device adapted for use with a bow, the latter being constituted of an arcuate, elastic bow frame, having a front and a rear face, and a cord extending opposite said rear face; said device comprising a liquid-filled cylinder, having a front-closed end, cylinder-securing means carried by said cylinder adapted to secure said cylinder to said bow frame with the rear portion of said cylinder intersecting and transversing the center portion of said bow frame, said cylinder-securing means include a pair of rigid braces fixed to said cylinder adjacent its front end, rearwardly diverging from said cylinder and adapted to be fixed to said bow frame, each brace including a length-adjusting means to vary its effective length, said cylinder-securing means further including a lateral stop member fixed to said cylinder adjacent its rear end and adapted to engage the rear face of said bow frame and with the front end of said cylinder spaced forwardly of the front face of said bow frame, a reciprocal piston within said cylinder, a piston rod fixed to said piston and protruding from the rear end of said cylinder, means at the outer end of said piston rod adapted to receive said cord, so that the latter may propel said piston inside said cylinder and a restricted passage at said piston allowing transfer of said liquid between the ends of said piston.

2. The device as defined in claim 1, wherein said length-adjusting means are turnbuckles.

3. The device as defined in claim 1, wherein said means adapted to receive said cord include a central recess engageable by said cord and a transverse pin removably carried by the outer end of said piston rod and extending across said recess to retain said cord within the recess.

4. The device as defined in claim 1, wherein said passage is a gap between said piston and the inside surface of said cylinder.

5. In combination, a practice device and a bow, the latter having an arcuate bow frame and a cord; said device comprising a liquid-filled cylinder, means to secure said cylinder to said bow frame transversely of its center portion, a reciprocal piston within said cylinder, a piston rod fixed to said piston and protruding from said cylinder, means at the outer end of said piston rod adapted to receive said cord, so that the latter may propel said piston inside said cylinder and a restricted passage at said piston allowing transfer of said liquid from one side to the other of said piston.

* * * * *